US006641361B2

(12) United States Patent
Yu

(10) Patent No.: US 6,641,361 B2
(45) Date of Patent: Nov. 4, 2003

(54) FUEL PUMP IMPELLER FOR HIGH FLOW APPLICATIONS

(75) Inventor: DeQuan Yu, Ann Arbor, MI (US)

(73) Assignee: Visteon Global Technologies, Inc., Dearborn, MI (US)

( * ) Notice: Subject to any disclaimer, the term of this patent is extended or adjusted under 35 U.S.C. 154(b) by 10 days.

(21) Appl. No.: 10/021,613

(22) Filed: Dec. 12, 2001

(65) Prior Publication Data

US 2003/0108418 A1 Jun. 12, 2003

(51) Int. Cl.[7] ..... F04D 5/00
(52) U.S. Cl. ..... 415/55.1
(58) Field of Search ..... 415/55.1, 55.4

(56) References Cited

U.S. PATENT DOCUMENTS

| | | | | |
|---|---|---|---|---|
| 4,188,169 | A | 2/1980 | Mowill | |
| 5,513,950 | A | 5/1996 | Yu | |
| 5,762,469 | A | 6/1998 | Yu | |
| 6,113,363 | A | 9/2000 | Talaski | |
| 6,296,439 | B1 * | 10/2001 | Yu et al. | 415/55.1 |
| 6,402,460 | B1 | 6/2002 | Fischer et al. | |
| 6,443,692 | B1 * | 9/2002 | Sakamoto et al. | 415/55.1 |

FOREIGN PATENT DOCUMENTS

| | | |
|---|---|---|
| EP | 0931 927 | 7/1999 |
| GB | 2 218 748 | 11/1989 |
| GB | 2 289 918 | 12/1995 |

* cited by examiner

*Primary Examiner*—Edward K. Look
*Assistant Examiner*—Kimya N McCoy
(74) *Attorney, Agent, or Firm*—Brinks Hofer Gilson & Lione

(57) ABSTRACT

An impeller for a fuel pump for supplying fuel to an automotive engine from a fuel tank includes an impeller body with a plurality of vanes having a front side and a back side extending radially outward therefrom. A plurality of partitions are interposed between the vanes and extend a radially shorter distance than the vanes. The partitions and the vanes define a plurality of vane grooves. Each of the vanes includes a root which is adjacent the impeller body and a distal end. The vanes have a thickness which varies such that the vanes are thickest at the root and gradually become thinner as the vanes extend outward to the distal end. A ring portion is fitted around the impeller and connected to the distal ends of the vanes such that a plurality of extending fuel flow passages are formed between the vanes, the partitions, and the ring portion.

22 Claims, 6 Drawing Sheets

FUEL PUMP IMPELLER FOR HIGH FLOW APPLICATIONS

TECHNICAL FIELD OF THE INVENTION

The present invention generally relates to an impeller for a fuel pump for an automotive vehicle.

BACKGROUND OF THE INVENTION

Regenerative fuel pumps having a ring impeller are well known technology. These type of fuel pumps are relatively cheap to manufacture, robust and efficient, particularly in lower flow high pressure applications. However, this type of fuel pump has disadvantages when used for higher flow applications. The structure of the ring impeller forms two flow chambers. One is an inlet side flow chamber and the other is an outlet side flow chamber. First, fuel flows into the inlet side flow chamber and across the impeller to an outlet hole. Secondly, fuel flows across the impeller near the inlet to the outlet side flow chamber and exhausts into the outlet hole. When the fuel flows across the impeller, there is a limited flow path so the velocity of the flow is increased. The increase in velocity of the fuel flowing across the impeller results in flow turbulence and pressure losses. The increase in turbulence increases the production of vapor in the fuel flow, which decreases the efficiency of the fuel pump. Additionally, if the fuel is hot, vaporization of the fuel occurs even more readily, thereby multiplying the problem of vapor production.

Traditional fuel pumps have tried to alleviate these problems by focusing on the fuel inlet areas of the fuel pump. These improvements do not address the issue of fuel vaporization in high flow automotive applications. Therefore, there is a need for an improved fuel pump impeller which will reduce the amount of fuel vaporization in high pressure, high flow applications.

DETAILED DESCRIPTION OF THE PREFERRED EMBODIMENTS

The following description of the preferred embodiment of the invention is not intended to limit the scope of the invention to this preferred embodiment, but rather to enable any person skilled in the art to make and use the invention.

Figure 1:
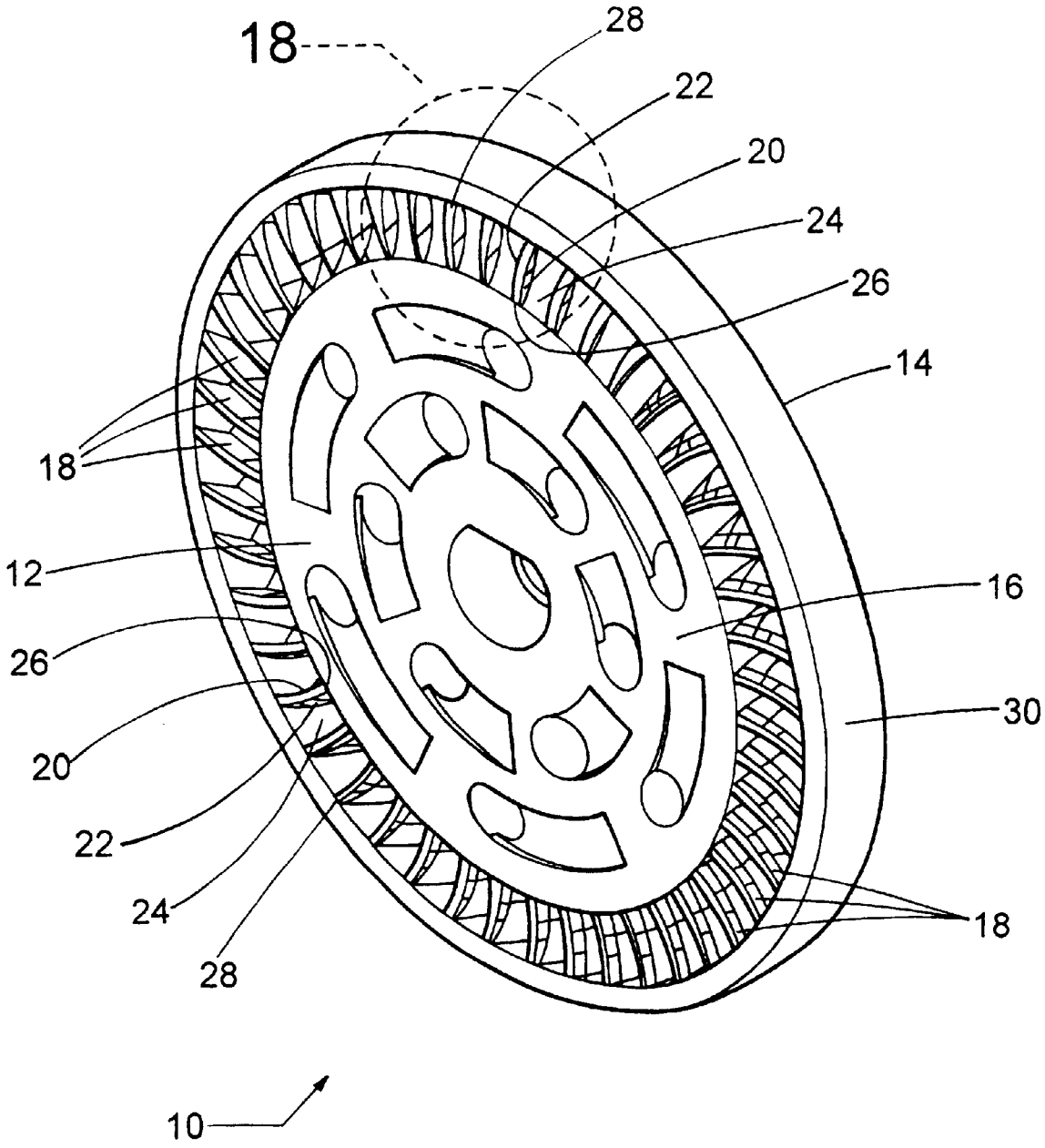
FIG. 1 is a perspective view of an impeller of the present invention.

Referring to FIG. 1, an impeller for a fuel pump for supplying fuel to an automotive engine from a fuel tank is shown generally at 10. The impeller 10 includes an impeller body 12 having a substantially disk shape with an input side 14, an output side 16 and an outer circumference. The impeller 10 includes a plurality of vanes 18 extending radially outward from the outer circumference of the impeller body 12. Each of the vanes 18 has a front side 20 and a back side 22. The impeller 10 is designed to rotate in one direction, and the front side 20 of vane 18 is the side of the vane 18 facing the direction of rotation.

The impeller includes a plurality of partitions positioned between each adjacent pair of vanes 18 which extend outward from the outer circumference of the impeller body 12 a shorter radial distance than the vanes 18. The partitions and the vanes 18 define a plurality of vane grooves 24. The point where the vanes 18 attached to the impeller body is the vane root 26. Each of the vanes 18 extend radially outward from the vane root 26 to a distal end 28. A ring portion 30 is fitted around and attached to the distal ends 28 of the vanes 18. The vanes 18, the vane grooves 24 and the ring portion 30 define a plurality of extending fuel flow passages extending from the inlet side 14 of the impeller to the outlet side 16 of the impeller.

Figure 2:
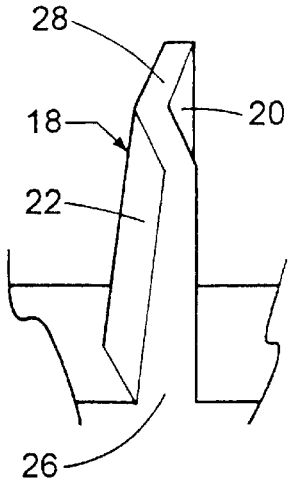
FIGS. 2–4 are perspective views of various vanes of the preferred embodiments.
Figure 3:
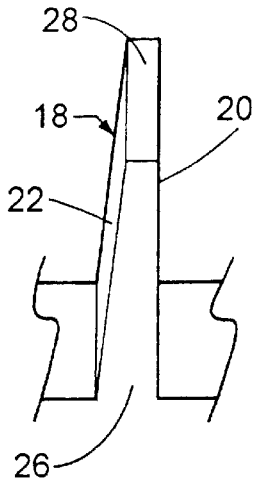
Figure 4:
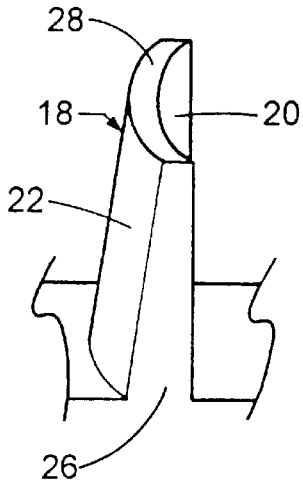

The shape of the vanes 18 can be any shape which is suitable for the particular application. Referring to FIGS. 2 through 4, three variations are shown without the ring portion 30. FIG. 2 shows a vane 18 with a V-shape, FIG. 3 shows a vane 18 with a flat shape and FIG. 4 shows a vane 18 with a curved shape. It is to be understood, that any type of shape could be suitable depending upon the particular characteristics of a particular application.

Figure 5:
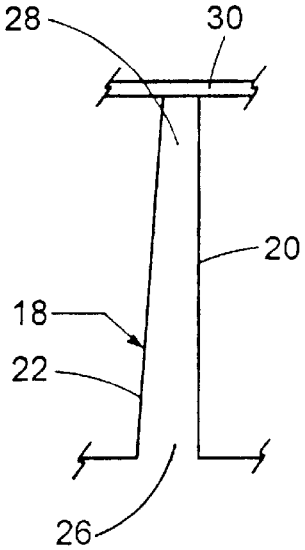
FIGS. 5–7 are side views of various vanes showing how the thickness of the vane become thinner from a vane root to a distal end.
Figure 6:
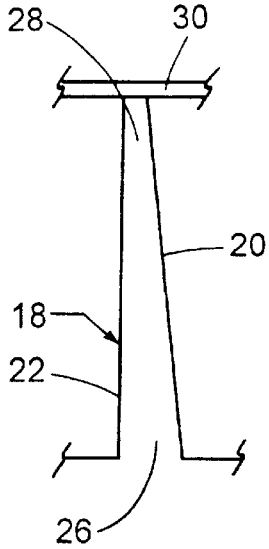
Figure 7:
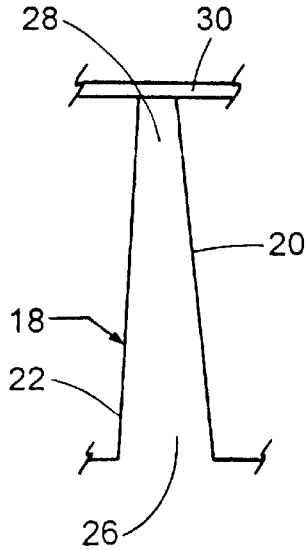

In a first aspect of the preferred embodiment, each vane 18 has a thickness which varies such that the vane 18 is thickest at the vane root 26 and gradually becomes thinner as the vane 18 extends outward to the distal end 28. Referring to FIGS. 5 through 7, the vane profile of either the front side 20 or the back side 22 changes such that the thickness of the vane 18 changes. In FIG. 5, the back side 22 extends outward to the distal end 28 at an angle relative to the vane root 26 such that the back side 22 moves closer to the front side 20 as the back side 22 extends outward to the distal end 28. In FIG. 6, the front side 20 extends outward to the distal end 28 at an angle such that the front side 20 moves closer to the back side 22 as the front side 20 extends outward to the distal end 28. In FIG. 7, both the front side 20 and the back side 22 extend outward to the distal end 28 such that the front side 20 and the back side 22 move closer to each other as the front side 20 and the back side 22 extend outward to the distal end 28.

The thickness of each of the vanes 18 is between about 0.2 millimeters and about 0.8 millimeters such that the thickness of each of the vanes 18 at the vane root 26 is less than about 0.8 millimeters and the thickness of each of the vanes 18 at the distal end 28 is at least about 0.2 millimeters. In the first preferred embodiment the thickness of each of the vanes 18 at the vane root 26 is about 0.4 millimeters and the thickness of each of the vanes 18 at the distal end 28 is about 0.25 millimeters.

In a variation of the preferred embodiment, each of the vanes 18 has a first section 32 which extends from the vane root 26 to a transition point 34 between the vane root 26 and the distal end 28 and a second section 36 which extends from the transition point 34 outward to the distal end 28. The thickness of the vanes 18 of the third preferred embodiment vary such that the thickness of the vanes 18 within the first section 32 is a constant thickness and the thickness of the vanes within the second section 36 gradually decreases as the vanes 18 extend outward from the transition point 34 to the distal end 28.

Figure 8:
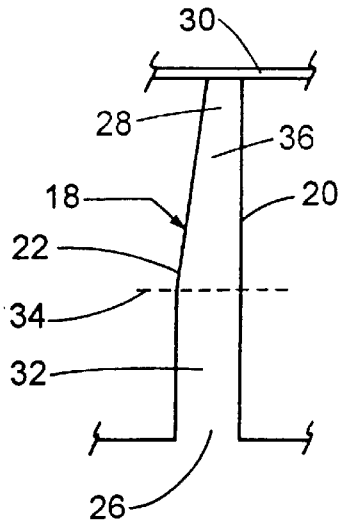
FIGS. 8–10 are side views of various vanes showing how the thickness of a second section becomes thinner toward the distal end of the vanes.
Figure 9:
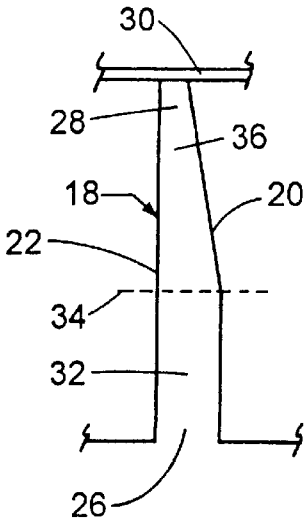
Figure 10:
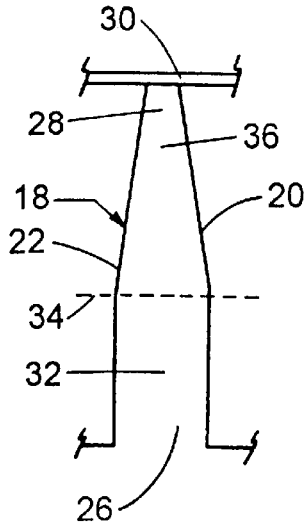

Referring to FIGS. 8 through 10, the thickness of the second section 36 can vary in three ways. FIG. 8 shows a vane 18 wherein the first section 32 of the back side 22 meets the second section 36 of the back side 22 at an angle such that the second section 36 of the back side 22 tapers toward the front side 20 as the second section 36 of the back side 22 extends outward from the transition point 34 to the distal end 28. FIG. 9 shows a vane 18 wherein the first section 32 of the front side 20 meets the second section 36 of the front side 20 at an angle such that the second section 36 of the front side 20 tapers toward the back side 22 as the second section 36 of the front side 20 extends outward from the transition point 34 to the distal end 28. FIG. 10 shows a vane 18 wherein the first section 32 of the front side 20 meets the second section 36 of the front side 20 at an angle, and the first section 32 of the back side 22 meets the second section 36 of the back side 22 at an angle such that the second sections 36 of the front side 20 and the back side 22 taper together as the second sections 36 of the front side 20 and the back side 22 extend outward from the transition point 34 to the distal end 28.

The thickness of the first section 32 of each of the vanes 18 is a constant thickness of less than about 0.8 millimeters. The thickness of the second section 36 of each of the vanes 18 is between about 0.8 millimeters and about 0.2 millimeters such that the thickness of the second section 36 is less than about 0.8 millimeters at the transition point 34 and the thickness of the second section 36 at the distal end 28 is at least about 0.2 millimeters. In the third preferred embodiment, the thickness of the first section 32 is about 0.4 millimeters and the thickness of the second section 36 at the distal end 28 is about 0.25 millimeters.

Figure 11:
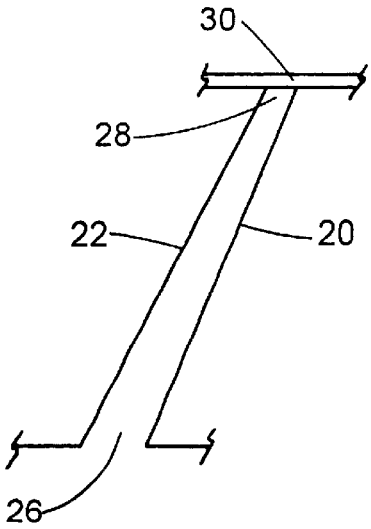
FIGS. 11–12 are side views of impeller vanes which are bent forward.
Figure 12:
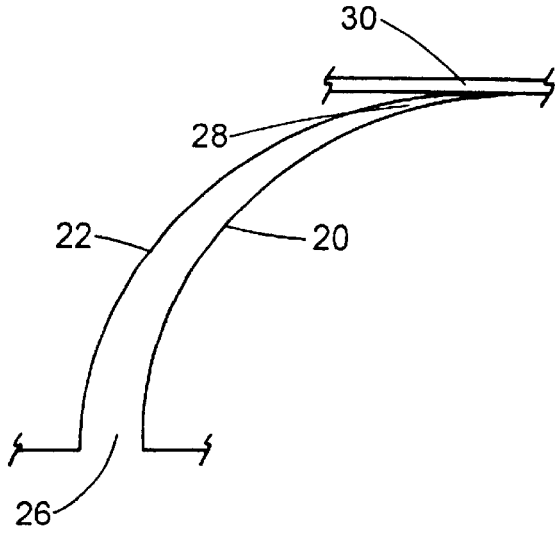

In a second aspect of the preferred embodiment, each vane 18 has a thickness which varies such that the vane 18 is thickest at the vane root 26 and gradually becomes thinner as the vane 18 extends outward to the distal end 28, and each of the vanes 18 is bent forward. Referring to FIGS. 11 and 12, the vanes 18 can be straight and tilted forward as shown in FIG. 11, or the vanes 18 can be curved forward as shown in FIG. 12. Preferably, the vanes 18 are tilted or curved toward the direction of rotation of the impeller 10. The thickness of the vanes 18 of the second preferred embodiment vary as the vanes 18 extend from the vane root 26 to the distal end 28 just as the vanes 18 of the first preferred embodiment.

Figure 13:
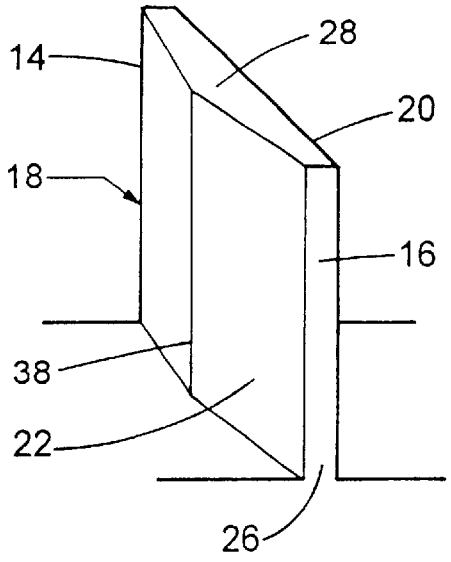
FIGS. 13–16 are perspective views if various impeller vanes where the front side of the vane tapers from an axial midpoint to one of or both the input side and the output side.
Figure 14:
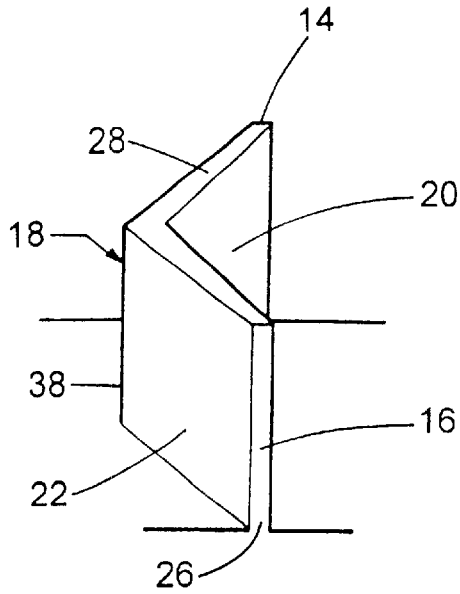

In a third aspect of the preferred embodiment, each vane 18 has a thickness which varies such that the vane 18 is thickest at the vane root 26 and gradually becomes thinner as the vane 18 extends outward to the distal end 28, and the vanes 18 each include a axial mid-point 38 located between the input side 12 and the output side 16 and each of the vanes 18 has a varying thickness such that the vanes 18 are thickest at the midpoint 38 and become gradually thinner towards the sides 14, 16. Referring to FIGS. 13 and 14, vanes 18 are shown where the vanes 18 are thickest at the midpoint 38 and become gradually thinner as the vanes extend axially outward to the input side 14 and the output side 16. FIG. 13 shows a flat vane and FIG. 14 shows an V-shaped vane. As shown in FIGS. 13 and 14, the back side 22 of the vane 18 tapers as the vane 18 extends outward to the input side 14 and the output side 16. Alternatively, the front side 20 of the vane 18 could taper or both the front side 20 and the back side 22 of the vane 18 could taper as the vane 18 extends outward to the input side 14 and output side 16.

Figure 15:
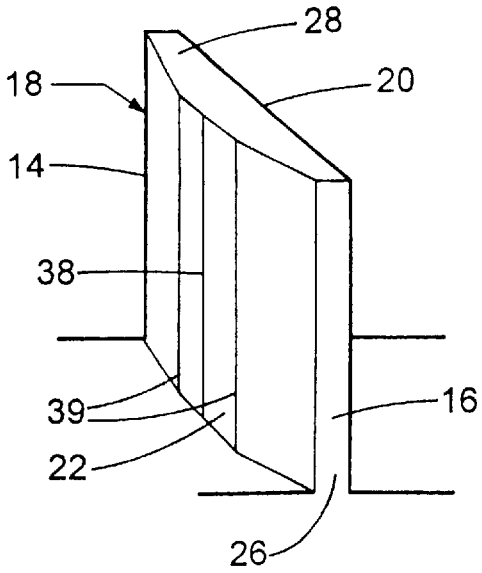
Figure 16:
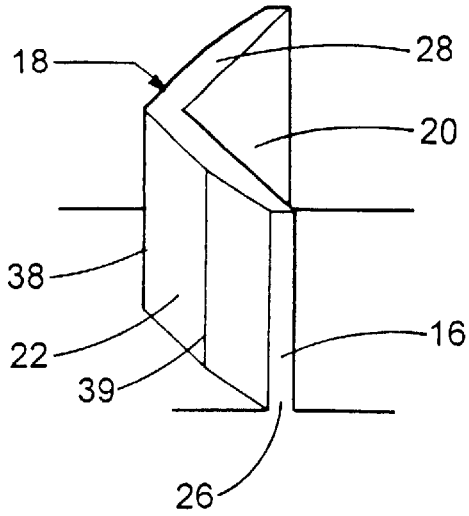

Referring to FIGS. 15 and 16, vanes 18 are shown without the ring portion 30 where the vanes 18 are thickest at the midpoint 38 and become gradually thinner as the vane 18 extends axially outward to the input side 14 and the output side 16. As shown in FIGS. 15 and 16, the taper of the vanes 18 can begin at an axial transition point 39 between the midpoint 38 and the input and output sides 14, 16. The vanes 18 maintain a constant thickness from the midpoint 38 to the axial transition points 39.

Figure 17:
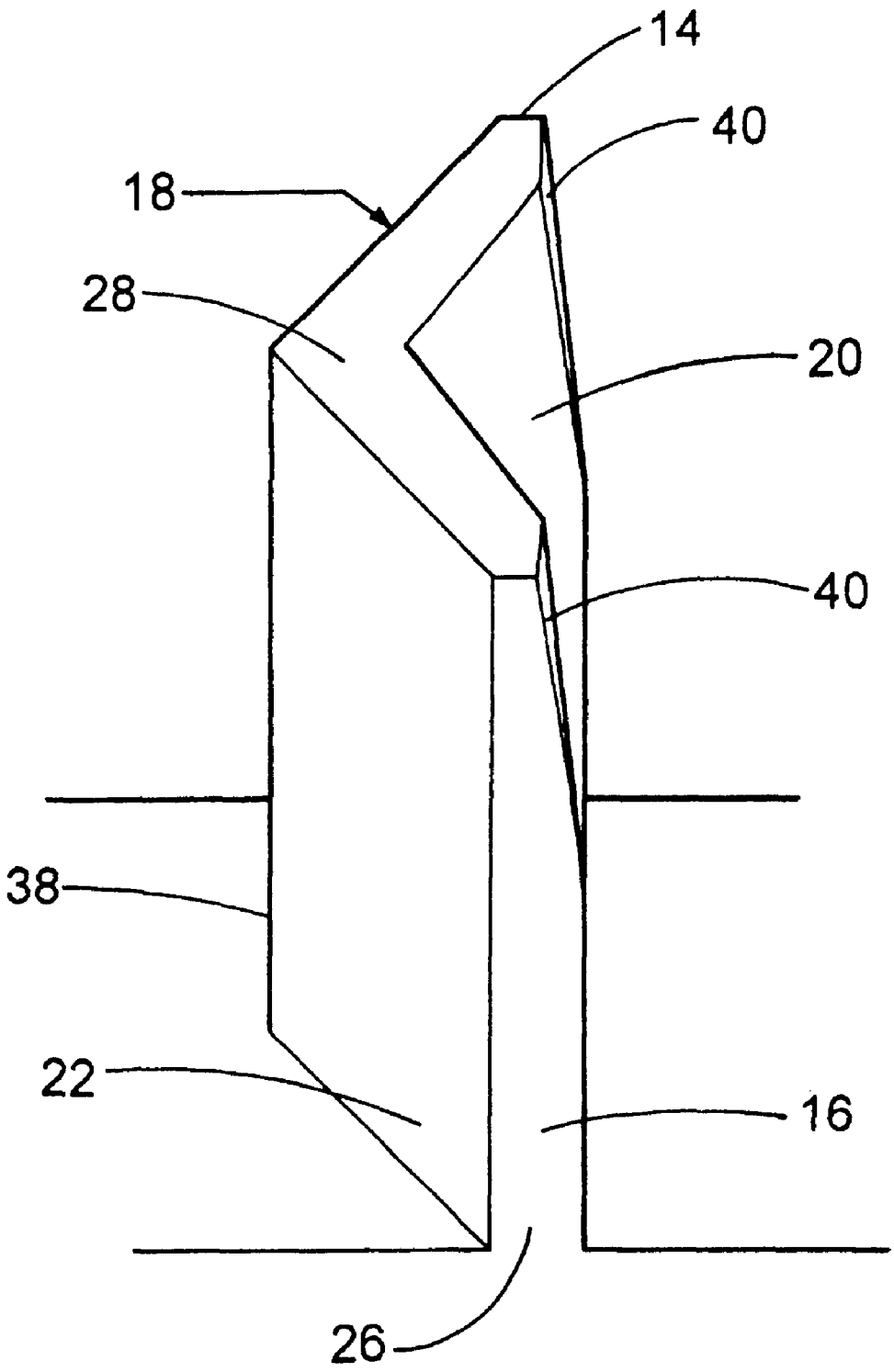
FIG. 17 is a perspective view of an impeller vane having a chamfer formed within the front side of the vane along the output side of the impeller.

Alternatively, the vanes 18 can includes a section on either the front side 20 or the back side 22 of the vane 18 where the thickness of the vane 18 becomes thinner in a defined area immediately adjacent the input side 14 or the output side 16. Referring to FIG. 17, a vane 18 is shown without the ring portion 30 and with a section of the front side 22 of the vane 18 immediately adjacent the output side 16 which is tapered down toward the output side 16 forming a chamfer 40 thereon. Preferably, the chamfer 40 does not extend downward from the distal end 28 of the vane 18 more than half way to the root 26. It is to be understood, that the thickness change within the vanes 18 between the midpoint 38 and the input side 14 or output side 16 can be limited to a chamfer 40, or the chamfer 40 may be formed within the vanes 18 in addition to a gradual thickness change along the vane 18 between the midpoint 38 or the axial transition point 39 and the input side 14 and output side 16.

Referring again to FIGS. 13 through 16, the thickness of each of the vanes 18 is between about 0.2 millimeters and about 0.8 millimeters such that the thickness of each of the vanes 18 at the midpoint 38 is less than about 0.8 millimeters and the thickness of each of the vanes 18 at the input side 14 and the output side 16 is at least about 0.2 millimeters. As shown in FIGS. 13 and 14, the thickness of each of the vanes 18 at the midpoint 38 is about 0.4 millimeters and the thickness of each of the vanes 18 at the input side 14 and the output side 16 is about 0.25 millimeters. As shown in FIG. 15 and 16, the thickness of each of the vanes 18 at the midpoint 38 and extending outward to the axial transition points 39 is about 0.4 millimeters and the thickness of each of the vanes 18 at the input side 14 and at the output side 16 is about 0.25 millimeters.

Figure 18:
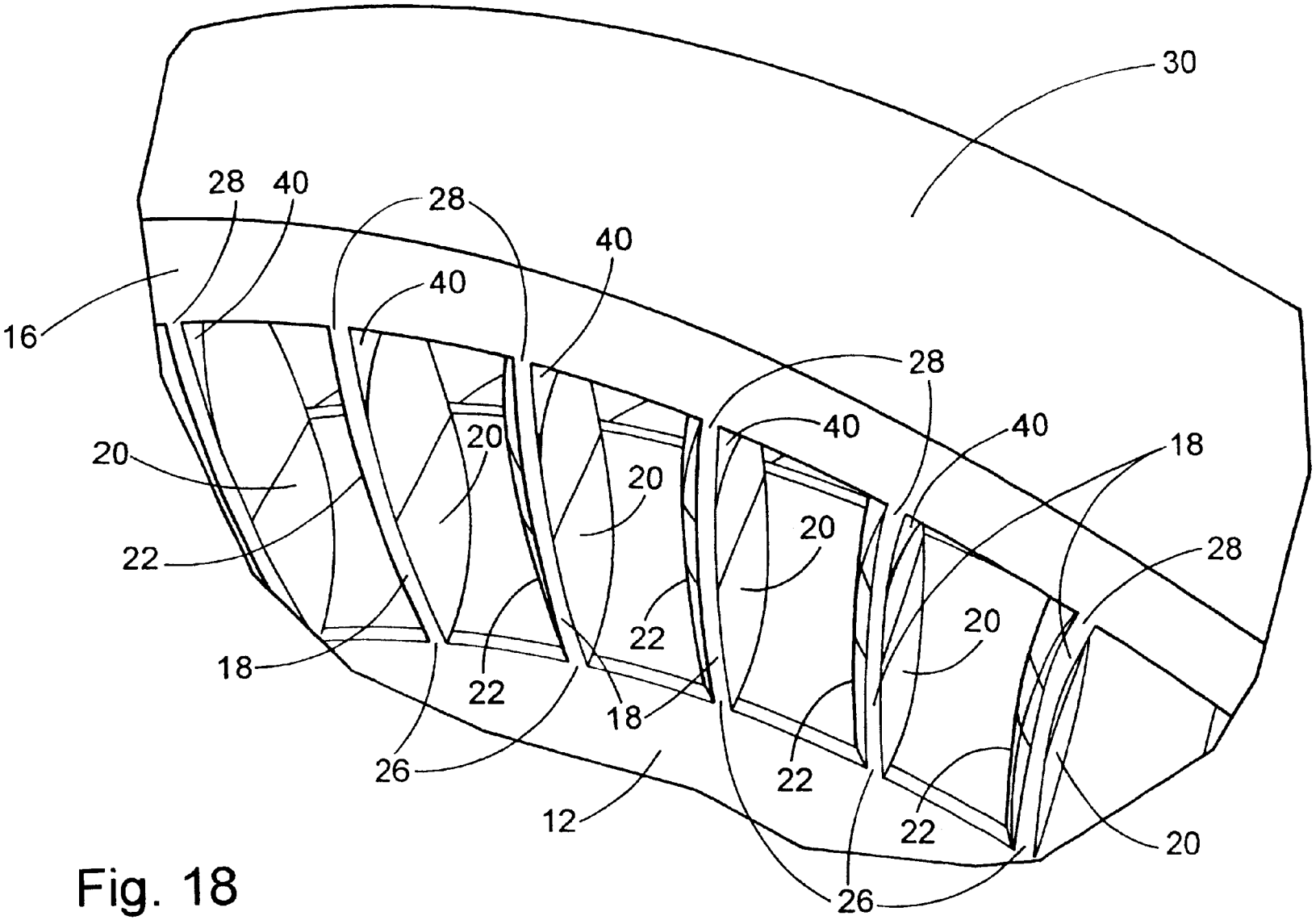
FIG. 18 is a close up view of the vanes of the impeller of FIG. 1.

Referring to FIG. 18, a close up of the output side 16 of the impeller 10 from FIG. 1 is shown. The vanes 18 include features of all three aspects of the preferred embodiment, wherein the front side 20 of each of the vanes 18 is substantially flat, but includes a chamfer 40 along the output side 16, and the back side 22 of the vanes 18 are tapered axially and radially, thereby giving a arcuate profile to the back side 22 of the vanes 18. The result is that the flow passage is opened up to allow smoother fuel flow across the impeller 10 and thereby reducing the amount of fuel vaporization in high flow and hot fuel handling applications.

The foregoing discussion discloses and describes three aspects of the preferred embodiment of the invention. One skilled in the art will readily recognize from such discussion, and from the accompanying drawings and claims, that changes and modifications can be made to the invention without departing from the true spirit and fair scope of the invention as defined in the following claims. The invention has been described in an illustrative manner, and it is to be understood that the terminology which has been used is intended to be in the nature of words of description rather than of limitation.

I claim:

1. An impeller for a fuel pump for supplying fuel to an automotive engine from a fuel tank comprising:

an impeller body having a substantially disk shape with an input side, an output side and an outer circumference;

a plurality of vanes having a front side and a back side and extending radially outward from said outer circumference of said impeller body with a plurality of partitions interposed therebetween extending a radially shorter distance than said vanes, said partitions and said vanes defining a plurality of vane grooves;

said vanes including a root which is adjacent said impeller body and a distal end, said vanes having a thickness which varies such that said vanes are thickest at said root and gradually become thinner as said vanes extend outward to said distal end;

a ring portion fitted around an outer circumference of said impeller and connected to said distal ends of said plurality of vanes such that a plurality of extending fuel flow passages are formed between said vanes, said partitions, and said ring portion.

2. The impeller of claim 1 wherein the thickness of each of said vanes is between about 0.2 millimeters and about 0.8 millimeters such that the thickness of each of said vanes at said root is less than about 0.8 millimeters and the thickness of each of said vanes at said distal end is at least about 0.2 millimeters.

3. The impeller of claim 2 wherein the thickness of each of said vanes at said vane root is about 0.4 millimeters and the thickness of each of said vanes at said distal end is about 0.25 millimeters.

4. The impeller of claim 1 wherein each of said vanes is bent forward.

5. The impeller of claim 1 wherein each of said vanes has a first section which extends from said root to a transition point between said root and said distal end and a second section which extends from said transition point outward to said distal end, the thickness of said vanes varying such that said first section has a constant thickness and said second section has a thickness which gradually decreases as said second section extends from said transition point outward to said distal end.

6. The impeller of claim 5 wherein said front side of each of said vanes has a profile wherein said first section meets said second section at an angle.

7. The impeller of claim 5 wherein said back side of each of said vanes has a profile wherein said first section meets said second section at an angle.

8. The impeller of claim 5 wherein said front side and said back side of each of said vanes have a profile wherein said front side within said first section meets said front side within said second section and an angle and said back side within said first section meets said back side within said second section at an angle.

9. The impeller of claim 5 wherein the thickness of said first section of each of said vanes is a constant thickness of less than about 0.8 millimeters and the thickness of said second section is between about 0.8 millimeters and about 0.2 millimeters such that the thickness of said second section is less than about 0.8 millimeters at said transition point and the thickness of said second section at said distal end is at least about 0.2 millimeters.

10. The impeller of claim 9 wherein the thickness of said first section is about 0.4 millimeters and the thickness of said second section at said distal end is about 0.25 millimeters.

11. The impeller of claim 1 wherein said vanes include an axial mid-point located between said input side and said output side and each of said vanes has a varying thickness such that said vanes are thickest at said midpoint and become thinner towards said input side and said vanes have a constant thickness from said midpoint to said output side.

12. The impeller of claim 11 wherein the thickness of each of said vanes varies in an area adjacent said input side thereby forming a chamfer along said vane adjacent said input side.

13. The impeller of claim 11 wherein the thickness of each of said vanes is between about 0.2 millimeters and about 0.8 millimeters such that the thickness of each of said vanes at said midpoint is less than about 0.8 millimeters and the thickness of each of said vanes at said input side is at least about 0.2 millimeters.

14. The impeller of claim 13 wherein the thickness of each of said vanes at said midpoint is about 0.4 millimeters and the thickness of each of said vanes at said input side is about 0.25 millimeters.

15. The impeller of claim 1 wherein said vanes include an axial mid-point located between said input side and said output side and each of said vanes has a varying thickness such that said vanes are thickest at said midpoint and become thinner towards said output side and said vanes have a constant thickness from said midpoint to said input side.

16. The impeller of claim 15 wherein the thickness of each of said vanes varies in an area adjacent said input side thereby forming a chamfer along said vane adjacent said input side.

17. The impeller of claim 15 wherein the thickness of each of said vanes is between about 0.2 millimeters and about 0.8 millimeters such that the thickness of each of said vanes at said midpoint is less than about 0.8 millimeters and the thickness of each of said vanes at said output side is at least about 0.2 millimeters.

18. The impeller of claim 17 wherein the thickness of each of said vanes at said midpoint is about 0.4 millimeters and the thickness of each of said vanes at said output side is about 0.25 millimeters.

19. The impeller of claim 1 wherein said vanes include an axial midpoint located between said input side and said output side and each of said vanes has a varying thickness such that said vanes are thickest at said midpoint and become thinner towards said input side and said output side.

20. The impeller of claim 19 wherein the thickness of each of said vanes varies in an area adjacent said input side and said output side thereby forming a chamfer along said vane adjacent said input side and said output side.

21. The impeller of claim 19 wherein the thickness of each of said vanes is between about 0.2 millimeters and about 0.8 millimeters such that the thickness of each of said vanes at said midpoint is less than about 0.8 millimeters and the thickness of each of said vanes at said input side and said output side is at least about 0.2 millimeters.

22. The impeller of claim 21 wherein the thickness of each of said vanes at said midpoint is about 0.4 millimeters and the thickness of each of said vanes at said input side and said output side is about 0.25 millimeters.

* * * * *